US005302224A

United States Patent [19]

Jenkins et al.

[11] Patent Number: 5,302,224

[45] Date of Patent: Apr. 12, 1994

[54] METHOD AND APPARATUS FOR CREATING IMAGES ON NAILS

[75] Inventors: Nevin Jenkins, Homosassa; Martin Fleit, Miami, both of Fla.

[73] Assignee: Fashion Nails, Inc., Miami, Fla.

[21] Appl. No.: 900,292

[22] Filed: Jun. 18, 1992

[51] Int. Cl.[5] ..... B41F 1/00

[52] U.S. Cl. ..... 156/230; 101/163; 156/235; 156/390; 424/61; 427/1

[58] Field of Search ..... 427/1; 424/61; 156/230, 156/235, 390; 101/163, 164, 41, 287

[56] References Cited

U.S. PATENT DOCUMENTS

| | | | |
|---|---|---|---|
| 2,246,729 | 6/1941 | Gutberlet | 101/163 |
| 2,519,335 | 8/1950 | Ballou et al. | 101/41 |
| 2,701,520 | 2/1955 | Rider | 101/41 |
| 2,842,046 | 7/1958 | Murray | 101/41 |
| 3,094,920 | 6/1963 | Priesmeyer | 101/41 |
| 3,898,357 | 8/1975 | Miller et al. | 156/235 |
| 3,916,784 | 11/1975 | Dubuit | 101/163 |
| 4,019,436 | 4/1977 | Handweiler et al. | 101/163 |
| 4,060,031 | 11/1977 | Philipp | 101/163 |
| 4,314,504 | 2/1982 | Combeau | 101/163 |
| 4,508,032 | 4/1985 | Philipp | 101/163 |
| 4,738,199 | 4/1988 | Chen | 101/163 |
| 5,151,386 | 9/1992 | Bottari et al. | 101/163 |

*Primary Examiner*—David A. Simmons
*Assistant Examiner*—William J. Matney, Jr.
*Attorney, Agent, or Firm*—Keck, Mahin & Cate

[57] ABSTRACT

A method and apparatus for creating an image such as out of a nail lacquer, picking up the image and transferring the picked up image either by a non-linear motion or a linear motion to a person's nail where it is deposited. A multicolor image can be built up on a person's nail. Stops are provided for properly indexing the pick up and deposit of the image.

15 Claims, 7 Drawing Sheets

METHOD AND APPARATUS FOR CREATING IMAGES ON NAILS

FIELD OF INVENTION

The present invention relates to a method and apparatus for coating, printing or otherwise transferring an image onto a finger or toe nail.

BACKGROUND OF INVENTION

The desirability of creating images on finger or toe nails is widely recognized. Known techniques include transfers, decals, appliques and hand painting. A need exists for a more expedient way to do this and to readily create more complex multicolor images of high quality that one can have done or do on a do-it-yourself basis.

SUMMARY OF INVENTION

The present invention provides an apparatus and method for creating single color or multicolor images on finger and toe nails in an efficient expeditious manner with a high definition clarity. This is accomplished by providing a method and apparatus that includes a first recess defining means to receive a finger or toe with the associated nail positioned to receive an image, a second recess defining means for loading an image to be placed on the nail and a transfer means having a pivotally mounted transfer pad for oscillating between the image pick up and nail to deposit the image. To create the image, a plate or cliche containing an image prepared by etching, engraving, lithography or any other known technique is loaded into the second recess defining means, a lacquer or other material to be deposited on the nail, such as glue, particulate material and the like, is coated over the image. Excess material is removed, such as by squeegeeing, and the transfer pad is oscillated or pivoted to a point above the image and contacted with the image to lift the lacquer or other material image from the image plate. The transfer pad is pivoted to a point above the nail and the lacquer or the material image is deposited, coated on, the nail. For multicolor images, the steps of the method are repeated for different colors for different parts of an image.

The principal object of the present invention is to provide a method and apparatus for effectively and efficiently creating images on a finger or toe nail.

Other objects and advantages of the present invention will become readily apparent from the following.

DESCRIPTION OF PREFERRED EMBODIMENT

Figure 1:
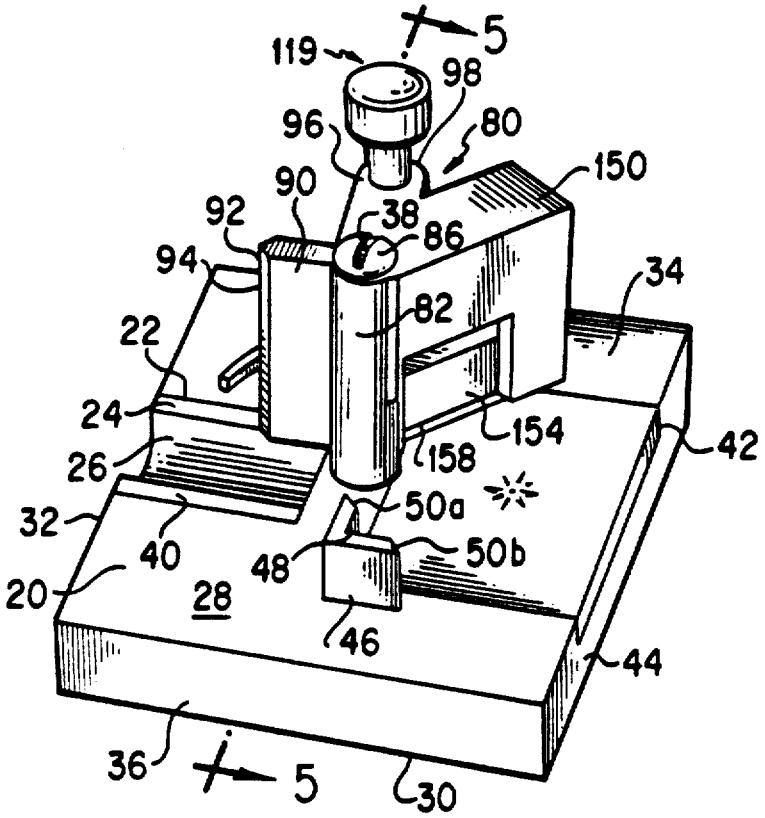
FIG. 1 is a perspective view showing the novel apparatus of the present invention.

Referring now to the drawings in detail, the apparatus of the present invention consists of a rectangular base plate 20 having an elongated through recess 22 that extends from and normal to side 32, parallel to adjacent sides 34 and 36 and terminates short and spaced from the midpoint 38 of base 20. The recess 22 is square cut and receives a rectangular parallel piped shaped block 24 which is complementary to recess 22 to make a snug f it but readily removable and replaceable. Block 24 has an elongated groove or depression 26 in its surface 40 for receiving a finger or toe 100 with its nail 102 presented or facing upwardly shown in phantom in FIGS. 2 and 3. The sizing or dimensions of groove 26 are selected so that a finger positioned in groove 26 presents its nail upwardly approximately lying in the plane of the top surface 28 of base 20. Feet, pads or friction means can be fastened to the bottom surface 30 of base 20 or the bottom surface 30 can have friction properties to facilitate that base 20, placed on a surface, such as a counter or table top, will not move or shift in use.

Figure 4:
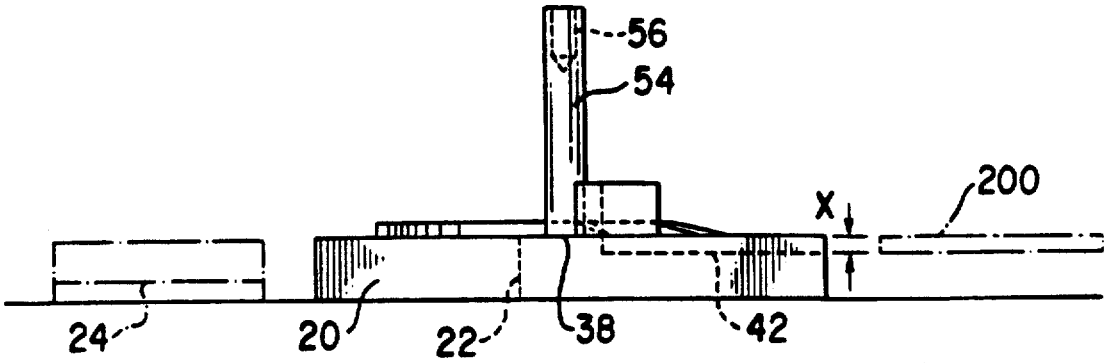
FIG. 4 is a side elevation of the base plate with the finger or toe receiving block and image plate shown removed and in phantom.

The opposed side 44 of base 20 is provided with a cutout 42 which extends from top surface 28 down into base 20 for a predetermined distance, see FIG. 4, about one-sixth to one-third of the thickness of the base 20. Cutout 42 extends into base 20 from side 44, parallel to adjacent sides 34, 36 and terminates short and spaced from midpoint 38 of base 20.

The top surface 28 of base 20 is provided with a number of projections. Projection 46 is right triangular in configuration and has a right angle cutout 48 along the hypotenuse **50*a*, 50*b* that coincides with one inner corner 52 of cutout 42 so that the part of projection 46 remaining forms a right angle stop coincident with corner 52 with surfaces 50*a* and 50*b* acting as the stop surfaces. Projection 54 is a right cylindrical post that is located coincident with midpoint 38 and extends vertically normal to surface 28 of base 20 for a substantial distance. The top of projection 54 is free standing and provided with a tapped axially extending bore 56**.

First arcuate projection or rib 60 extends vertically normal to surface 28, is about one fourth the height of projection 46, is relatively short, is close to projection 54 and extends in a circular path about midpoint 38 horizontally from the inner end of recess 22 around to the inner end 64 of cutout 42. The terminal portion 66 of projection or rib 60 nearest cutout 42 is gently beveled. Second arcuate projection or rib 70 extends vertically normal to surface 28, is about one fourth the height of projection 46, is remote from projection 54, and extends in a circular path about midpoint 38 horizontally from adjacent edge 72 of recess 22 to edge 74 of cutout 42. The terminal portion 76 of rib 70 nearest cutout 42 is gently beveled.

Pivotally mounted on post 54 is a carrier block 80 consisting of a cylindrical hub 82 containing a bore 84 adapted to receive post 54 or rather for mounting block 80 onto post 54 for pivotal or oscillatory movement about the axis of post 5. Screw 86, with or without a washer holds block 80 on post 54 while permitting the noted pivotal movement. Block 80 has three integrally connected parts projecting radially from hub 82. A first projecting part is blade 90 the free end 92 of which is tapered to an edge 94. Spaced 90° from blade 90 is a second projecting part 96 that terminates in a rounded end 98 in which a through bore 106 is formed having an enlarged section 108 penetrating about 60% of the way through end 98 and a smaller section 110 with a shoulder 112 formed between the two sections. The center or axis of bore 106 and the edge 94 of blade 90 lie on a common circle whose center is midpoint 38. Second projection 96 is cut out at the bottom or terminates spaced from the bottom edge 114 of hub 82 so that its bottom is spaced above the top surface 28 of block 20.

A plunger or push pin 119 consisting of an enlarged shaft section 120, integrally formed at its top end with a knob 122, fits into bore 106 for relative sliding movement. A reduced shaft section 124 is integrally formed at its upper end with the lower end of section 120 with a shoulder 126 formed between these sections. The lower end of section 124 extends through bore 110 and has attached to it a cup shaped pad holder 128 having an oval or racetrack configuration in horizontal section and at its open end. The inner end or bottom of the pad holder 128 has a countersunk opening 130 at its center, the lower end or bottom of section 124 has a tapped axial bore 132 and a screw holds the pad holder 128 to the lower end of section 124. A pad 134 composed of a suitable transfer material such as high density silicone rubber, is press fitted or adhesively secured in pad holder 128. A compression spring 140, slightly loaded, is located in bore 106, surrounding section 124 and bears against the shoulder 126 at its upper end and shoulder 112 at its lower end. Pad holder 128 serves as a stop for push pin 119, which in repose is pushed up with pad 134, withdrawn upward away from surface 28. However, the dimensioning is such that pressing push pin 119 downwardly causes pad 134 to move down to contact the plane of surface 28 with whatever pressure desired.

The third projecting part of carrier 80 is a squeegee mounting block 150. As noted first and second projecting parts are circularly displaced about midpoint 38 by 90°. The third projecting part is circularly displaced about midpoint 38 by 45° from the second projecting part. The block 150 terminates spaced above the plane of surface 28 and defines a rectangular cut out 152 in its lower end that opens downwardly. Fitted into cutout 152 is a squeegee holder 154 that has a vertical slot 156 formed or cut into its lower or bottom surface in which a spring steel squeegee 158 is force fitted to project a short distance below the bottom of holder 154. On either side of slot 156 is formed a recess 159 connecting with a bore 160 that continues through holder 154. The bores 160 are axially aligned with tapped bores 162 formed in block 150. Screws 163, with compression springs 164 mounted about their shafts, fit into recesses 159, pass through bores 160 and are threaded into bores 162 so that springs 164 normally bias or urge the squeegee holder 154, and therefore squeegee 158 against the plane of top surface 28 with a sufficient force for effective functioning of the squeegee 158. The holder 154 can effect vertical sliding movement in cutout 152 of block 150 relative to screw (or bolts) 163 against the bias of springs 164; sufficient clearance is provided to lift the squeegee a short distance above the plane of surface 28.

Figure 10:
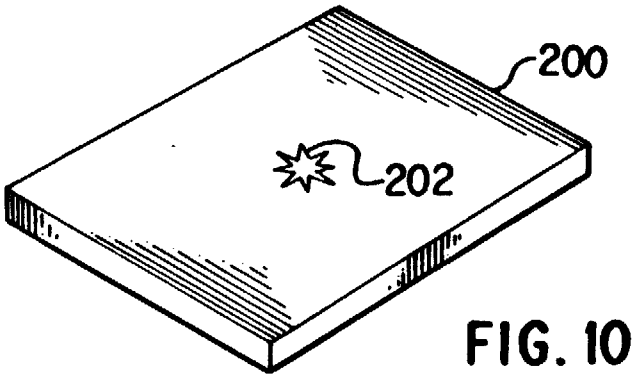
FIG. 10 is a perspective view of the image plate.

In FIG. 10 is shown a typical image plate 200 which may be composed of steel or the like or a suitable plastic. The thickness, width and length are chose to fit into cutout 42 with the top surface of plate 200 in the plane of surface 28. Formed in plate or cliche 200 is an image 202 of any design by any known means such as etching or engraving to a depth of about 4 thousandths. The location of the image is on the same circle which has midpoint 38 as its center and which includes the edge 94 of blade 90 and the center of pushpin 119 (and therefore, the center of pad 134). In short, all critical components lie equal radii from midpoint 38.

Figure 3:
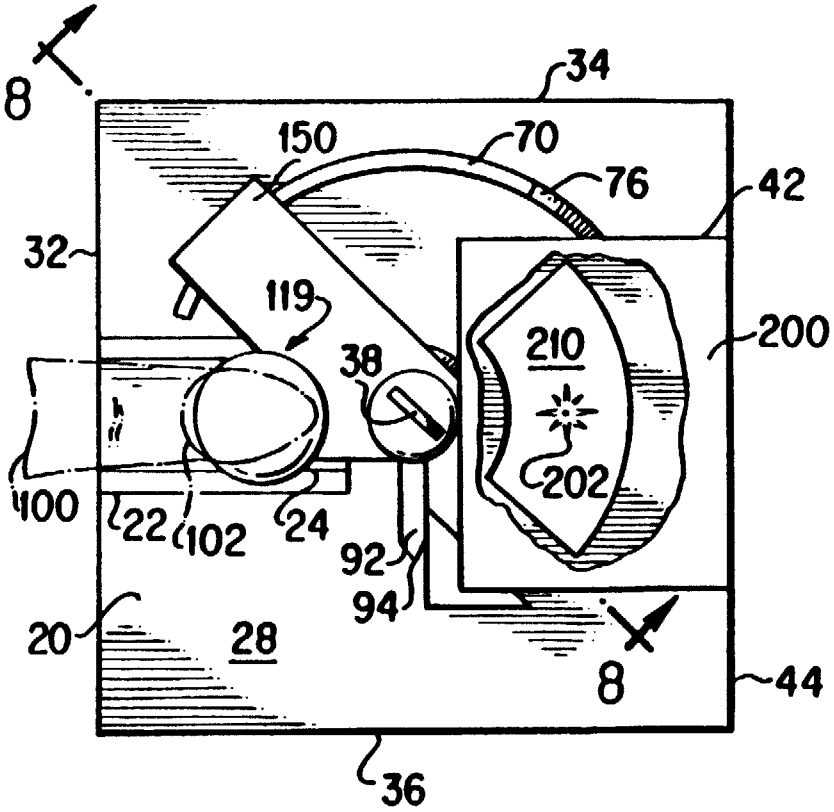
FIG. 3 is a top plan view of the apparatus depicted in FIG. 1 shown in the position of image deposit.
Figure 2:
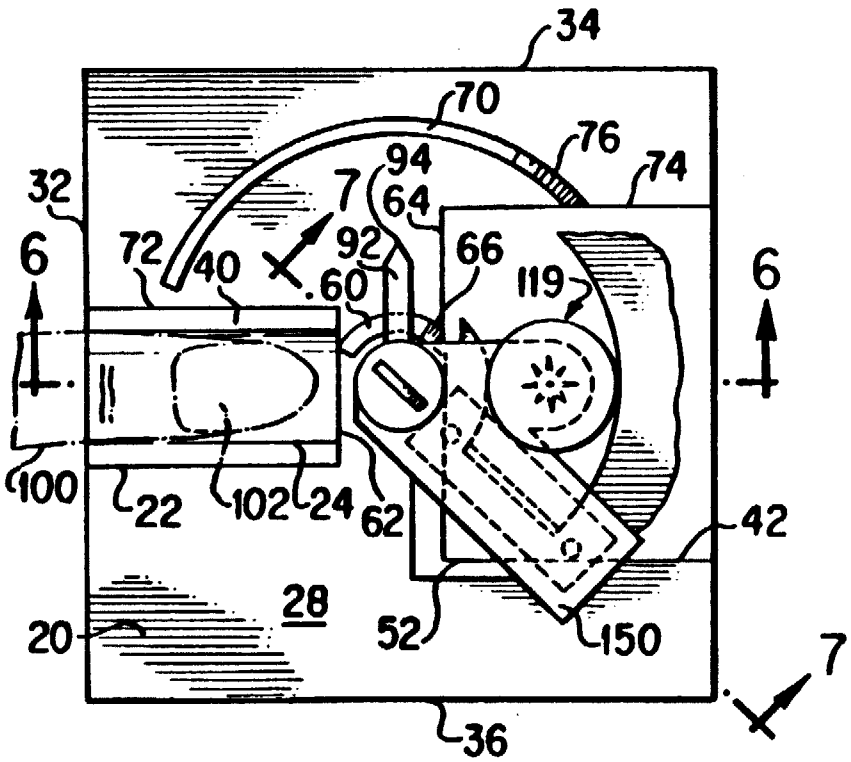
FIG. 2 is a top plan view of the apparatus depicted in FIG. 1 shown in the position of image pickup.
Figure 6:
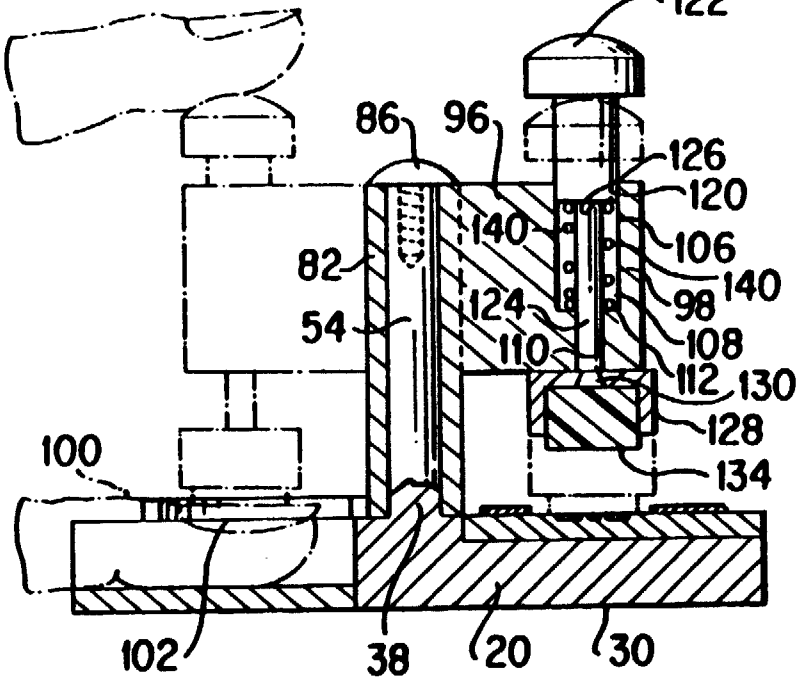
FIG. 6 is a sectional view taken along line 6—6 of FIG. 2.
Figure 5:
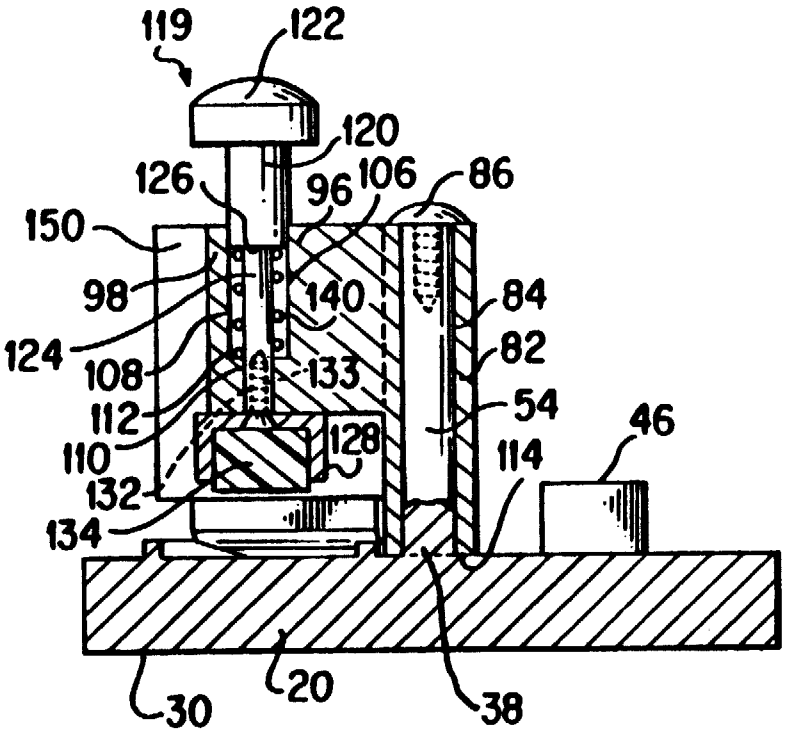
FIG. 5 is a sectional view taken along line 5—5 of FIG. 1.
Figure 8:
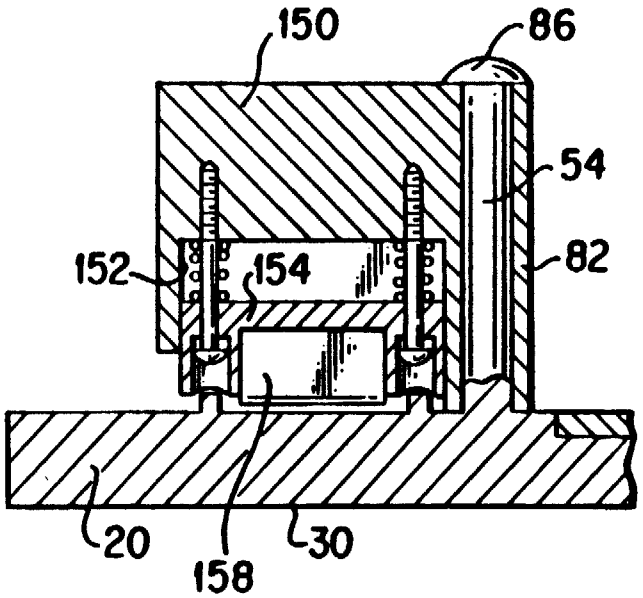
FIG. 8 is a sectional view taken along line 8—8 of FIG. 3.
Figure 7:
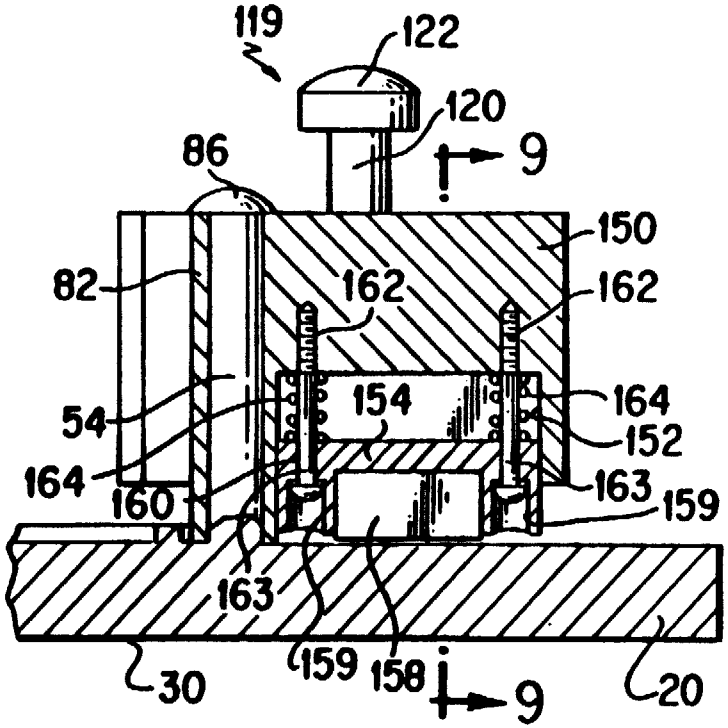
FIG. 7 is a sectional view taken along line 7—7 of FIG. 2.
Figure 11:
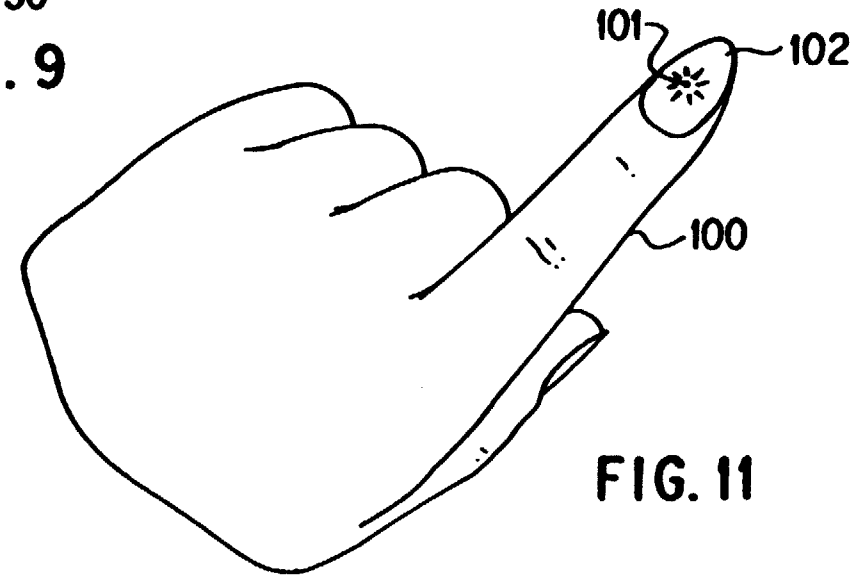
FIG. 11 is a perspective diagrammatic view of a hand with the index finger extended nail up showing a deposited image.
Figure 9:
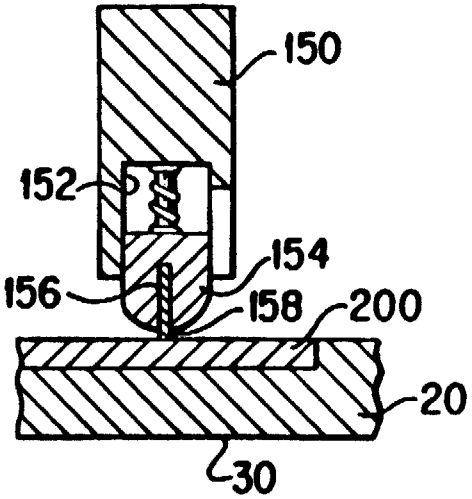
FIG. 9 is a sectional view taken along line 9—9 of FIG. 7.

The method of the invention will now be described in conjunction with the operation of the apparatus. Initially an image plate 200 is selected and loaded into cutout or slot or recess 42. A block 24 is selected having a groove or depression 26 that matches the finger 100 and associated nail 102 on which the image is to be deposited or coated such that the finger nail 102, when positioned will be near or substantially at the plane of top surface 28. The finger 100 and nail 102 are positioned in groove 26. Carrier block 80 is pivoted or oscillated so edge 94 is aligned over and points down to a spot on the fingernail 102 on which deposition is desired. At this time the squeegee holder 154 is riding on ribs 60 and 70 with blade 158 retracted, and image plate 200 is clear. This is the position of carrier 80 depicted in FIG. 1. Lacquer or other coating material is deposited over the image 202. Carrier 80 is now pivoted, rotated or oscillated about midpoint 38, clockwise as shown in FIGS. 1-3; at first the squeegee holder 154 rides down the ramps 66 and 76 and then squeegee 158 contacts the surface 28 and top surface of image plate 200 with appropriate pressure to effectively squeegee. Next squeegee 158 will squeegee an arcuate swath or area 210 that includes image 202, see FIG. 3, and eventually arrive at stop 46, more particularly contacting faces **50*a* and 50*b*. At this time, since stop 46 is circularly displaced from image 202 by 45°, pad 134 will be vertically and horizontally aligned over image 202. This is depicted in FIG. 2. When push pin 119 is depressed, pad 134 will contact the remaining coating material defining image 202 and lift same when push pin 119 is released, see FIG. 6. Carrier 80 will now be rotated counterclockwise as seen in FIGS. 1-3 until pad 134 is directedly positioned over nail 102 at the precise point designated initially by edge 94. This is assured because blade 90, which is circularly (angularly) displaced from pad 134 by 90° is now stopped by stop 46 at the precisely appropriate angular position, see FIG. 3 and phantom depiction of FIG. 6. Depressing push pin 119 (see FIG. 6) now transfers or deposits the image 101 onto the fingernail 102 to obtain the result shown in FIG. 11**.

Although the invention has been described as creating a single image, multicolor images can be created by serially transferring portions of an image in different colors. Also, image plate 200 can be made to contain two images on each side by redimensioning the plate by itself so it can be inserted into cutout 42 first on one edge and then withdrawn and inserted on the other edge. Then the plate can be turned over. In this manner each plate can carry four images.

Figure 13:
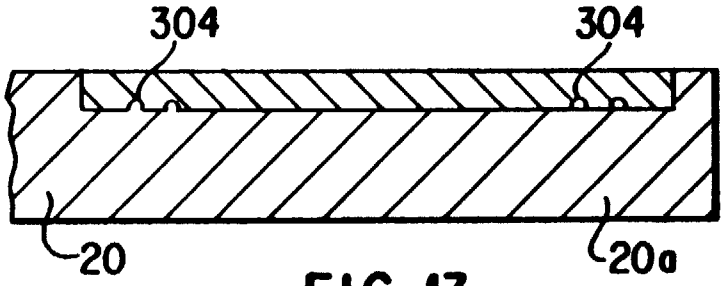
FIG. 13 is a section taken along line 13—13 of FIG. 12.
Figure 12:
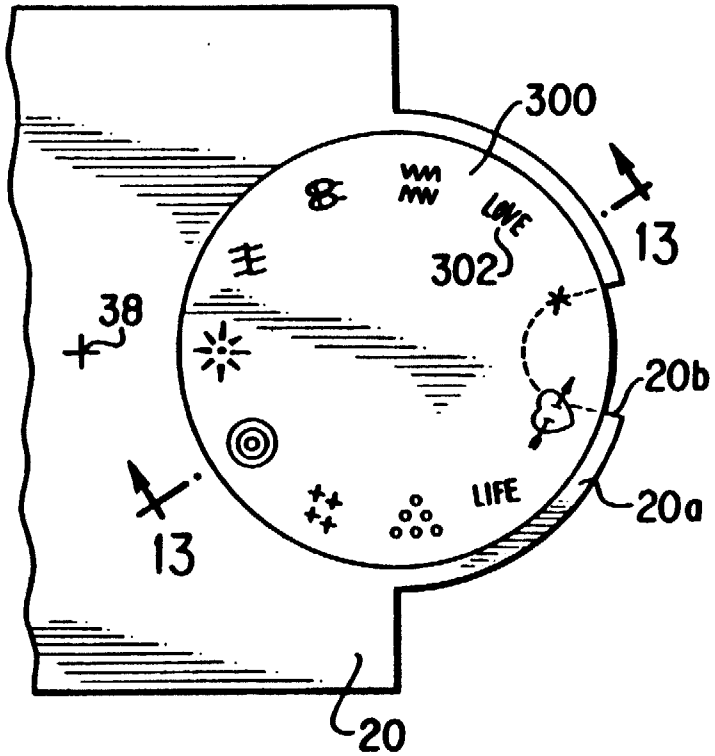
FIG. 12 is a top plan view of an alternative arrangement for mounting an image plate.

Also, cutout 42 can be circular as shown in FIGS. 12 and 13 so that an image plate 300 can carry a large number of images 302 on each side. The images 302 are peripherally spaced about plate 300 and matching indexing bumps or projections 304 on plate 20 cooperate with recesses or depressions to load plate 300 in the proper orientation with an image 302, 180° displaced from groove 26 and on the circle including the center of pad 134. Base plate 20 can have a hemispherical or chordal extension 20*a* provided with a cutout 20*b* to facilitate lift out and reorientation of the image plate 300. The images 302 may constitute portions of an overall multicolor image.

Figure 14:
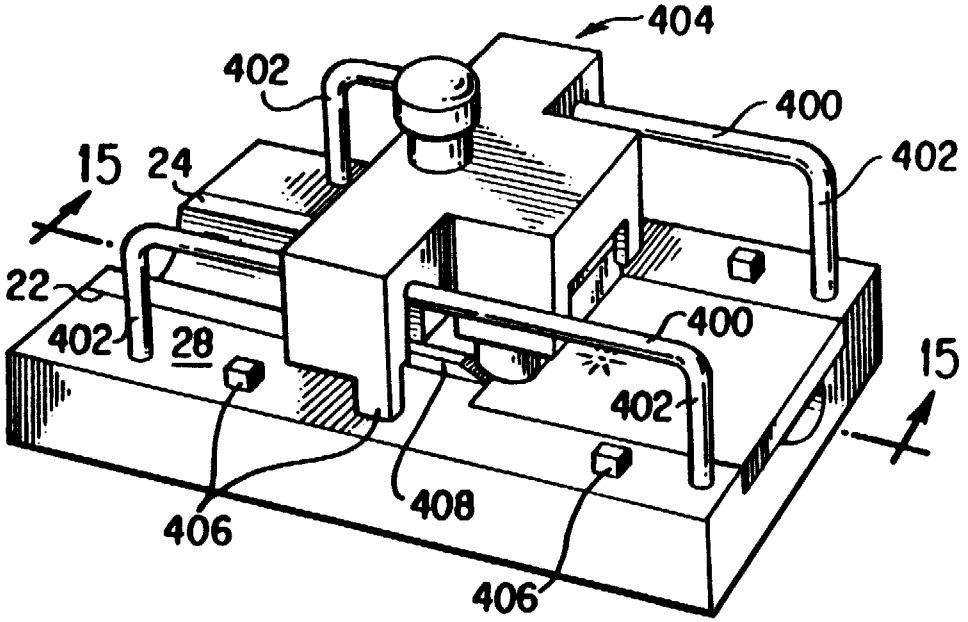
FIG. 14 is a perspective view showing an alternative apparatus according to the invention that works on a reciprocating principle.
Figure 15:
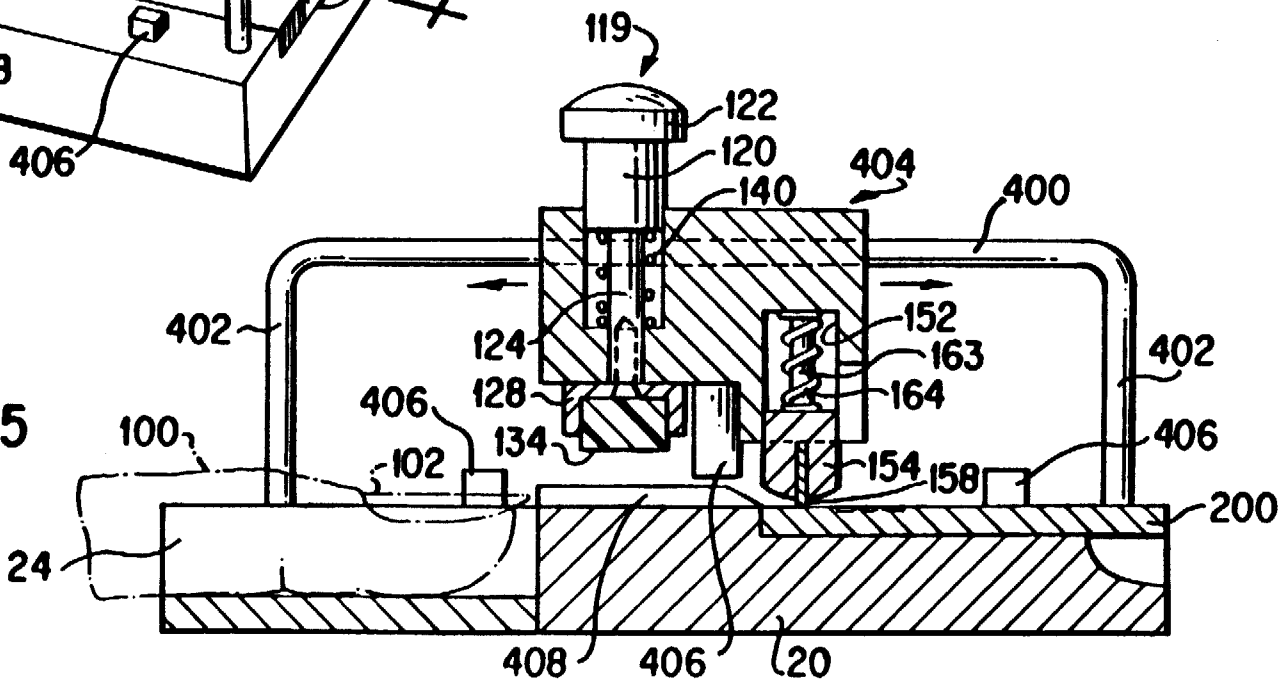
FIG. 15 is a section taken along line 15—15 of FIG. 14.

FIGS. 14 and 15 show alternative apparatus according to the present invention that works on a reciprocating principle. As shown, base plate or block 20 is provided with finger holding block 24 fitted into cutout 22 and image plate or cliche 200 fitted into cutout 42. A pair of tracks or guide rails 400 are held or supported in spaced relation and spaced above the top surface 28 of base block 20 by means of struts or frame members 402. A carriage block 404 is carried by and rides on rails 400. Cooperating stops 406 are provided on the block 404 and top surface 28 of base block 20 to prevent over travel of the squeegee 158 and to properly position the pad 134 over the fingernail 102 situated in the groove of block 24. The squeegee 158 and pad 134 are arranged in carriage block 404 as previously described and like reference numerals have been given for like parts. This apparatus works similar to the previous description. Lacquer is deposited over the image 202 on the image plate or cliche 200. The carriage block 404 is reciprocated to the right as viewed in FIG. 14 and squeegee 158 removes excess lacquer. The stops 406 position pad 134 above the image, whereupon it is picked up. Sliding or reciprocating the carriage to the left as viewed in FIG. 14 brings the pad 134 over the fingernail, stops 406 ensuring the correct positioning whereupon the image is deposited on the nail. Ribs or projections 408 lift the squeegee 158 away from surface 28 as the pad 134 is moved over the nail.

Figure 16:
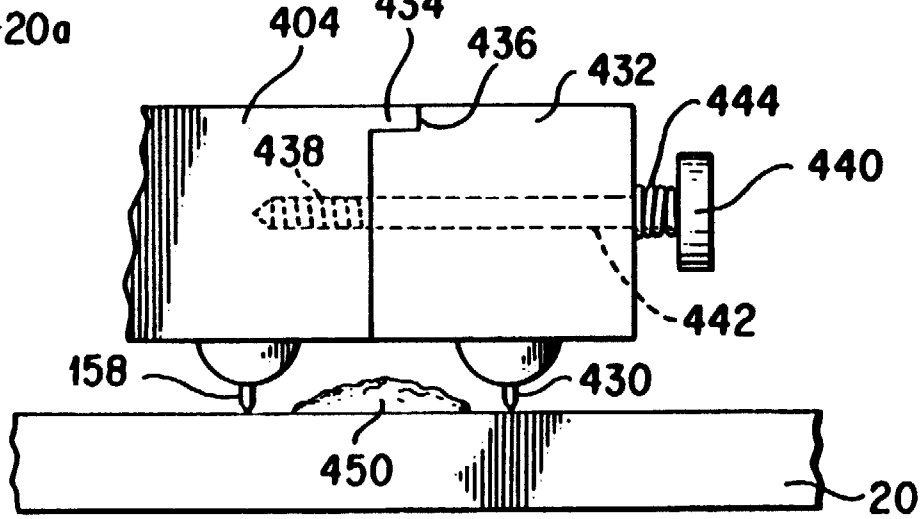
FIG. 16 is a schematic view showing two spaced squeegees.

One alternative to the apparatus or device as described above is to use a double squeegee. A second squeegee can be spring mounted like the first squeegee but in its own block and can be quickly detachably mounted such as by detents, bayonet fasteners, hooks etc. with the block of the first squeegee on the side remote from the pad holder so that the second squeegee is spaced from the first one. An example of such a quick detachable mounting is shown in FIG. 16 for the embodiment of FIGS. 14 and 15. The first squeegee 158 in block 404 has attached to it a second squeegee 430 mounted in block 432 like the first squeegee 158 (spring loaded). Block 404 is provided with a projecting lip 434 which fits into cutout 436 of block 432. A tapped bore 438 is formed in block 404 and a screw 440 passing through a bore 442 in block 432 can thread into bore 438. A spring 444 urges block 432 against block 404. Any other quick detachable connection can be used. Block 432 can be removed from block 404 for cleaning and lacquer (see pool 450) can be located between the squeegees. Thus reciprocating movement reloads the cliche.

Although the invention has been shown and described in terms of preferred embodiments, nevertheless changes and modification are possible which do not depart from the inventive teachings herein; such are deemed to come within the purview of the present invention as claimed herein.

What is claimed is:

1. A method for applying an image on a person's nail comprising the steps of:

establishing a reference point, positioning a person's nail in a block removably located on a supporting base at a first preselected location relative to said reference point, creating an image composed of an image defining coating material on a plate removably located on the supporting base at a second preselected location relative to said reference point, picking up the created image by a transfer means mounted on the supporting base from said second preselected location and transferring over the upper surface of the supporting base to the person's nail at said preselected location.

2. A method according to claim 1 wherein the picked up image is transferred by a nonlinear motion.

3. A method according to claim 1 wherein the picked up image is transferred by a nonlinear motion.

4. A method according to claim 2 wherein the nonlinear motion includes rotation.

5. A method according to claim 3 wherein the linear motion includes reciprocation.

6. A method according to claim 1 wherein said first and second preselected locations are equidistant from the reference point.

7. A method according to claim 1 further including a step of positively stopping the picked up created image in proper orientation to the person's nail during transfer.

8. Portable self contained apparatus for applying an image on a person's nail comprising:

a base having an upper horizontally extending surface defining a first cutout and spaced therefrom a second cutout, image creating means including a plate received in said first cutout for creating thereon an image composed of an image defining coating material in the plane of said horizontally extending surface, positioning means including a block received in said second cutout for positioning a person's nail on said base generally in the plane of said horizontally extending surface spaced relative to the location of the created image and in a given relative orientation thereto, and transferring means mounted on said base and including a carriage movable over the generally horizontally extending surface for transferring the created image from the image creating means to the person's nail by travelling over the generally horizontally extending surface.

9. Apparatus according to claim 8 wherein said substrate includes a plurality of images formed thereon.

10. Apparatus according to claim 8 wherein said transferring means includes a squeegee means for removing excess coating material from an image and pick up means for picking up a created image.

11. Apparatus according to claim 8 wherein said transferring means includes moving means for non-linearly moving the created image.

12. Apparatus according to claim 8 wherein said transferring means includes moving means for linearly moving the created image.

13. Apparatus according to claim 10 wherein said squeegee means and said pick up means are mounted in common for one of rotary and reciprocating movement.

14. Apparatus according to claim 13 further comprising stop means for indexing said pick up means relative to the created image and the person's nail.

15. Apparatus according to claim 10 wherein said squeegee means includes a pair of squeegees arranged in a spaced relation.

* * * * *